US005137678A

United States Patent [19]

Hess et al.

[11] Patent Number: 5,137,678

[45] Date of Patent: Aug. 11, 1992

[54] METHOD FOR CALENDERING A PAPER OR CARDBOARD WEB COATED AT BOTH SIDES

[75] Inventors: Harald Hess, Grunkraut; Rudiger Kurtz, Immenstaad a.B., both of Fed. Rep. of Germany

[73] Assignee: Sulzer Escher Wyss GmbH, Ravensburg, Fed. Rep. of Germany

[21] Appl. No.: 681,735

[22] Filed: Apr. 8, 1991

[30] Foreign Application Priority Data

Apr. 9, 1990 [DE] Fed. Rep. of Germany ..... 4011394

[51] Int. Cl.[5] ..... B29C 43/24

[52] U.S. Cl. ..... 264/280; 162/136; 162/206; 264/25; 427/361; 427/366

[58] Field of Search ..... 264/280, 175, 25; 162/136, 206; 100/38, 93 RP, 153, 161; 427/361, 366

[56] References Cited

U.S. PATENT DOCUMENTS

| | | | |
|---|---|---|---|
| 3,802,044 | 4/1974 | Spillmann et al. | 29/113 AD |
| 3,885,283 | 5/1975 | Biondetti | 29/116 AD |
| 3,996,328 | 12/1976 | Coffin et al. | 264/280 |
| 4,670,102 | 6/1987 | Maurer et al. | 100/161 |
| 4,960,046 | 10/1990 | Amstotz et al. | 100/93 RP |
| 4,973,441 | 11/1990 | Keller | 427/361 |
| 5,033,373 | 7/1991 | Brendel et al. | 162/206 |

FOREIGN PATENT DOCUMENTS

| | | |
|---|---|---|
| 2230139 | 1/1973 | Fed. Rep. of Germany . |
| 2254392 | 12/1976 | Fed. Rep. of Germany . |
| 3920204 | 5/1990 | Fed. Rep. of Germany . |

*Primary Examiner*—James Lowe

*Attorney, Agent, or Firm*—Sandler, Greenblum, & Bernstein

[57] ABSTRACT

To achieve desired treatment results at both sides of a material web to be calendered, the material web is initially guided through a first nip formed between yieldable elastic surfaces confronting the throughpassing material web. In the first nip there is predominantly applied a relatively high pressure to the material web. Then the material web is guided through a successively arranged second nip formed between practically non-yieldable hard surfaces confronting the throughpassing material web. In the second nip there is applied, apart from pressure, in particular heat to the material web. The treatment result achieved in the first nip, namely the smoothness and glaze values of the treated material web, are augmented at both sides of the material web to achieve desired treatment effects.

16 Claims, 1 Drawing Sheet

Fig- 1
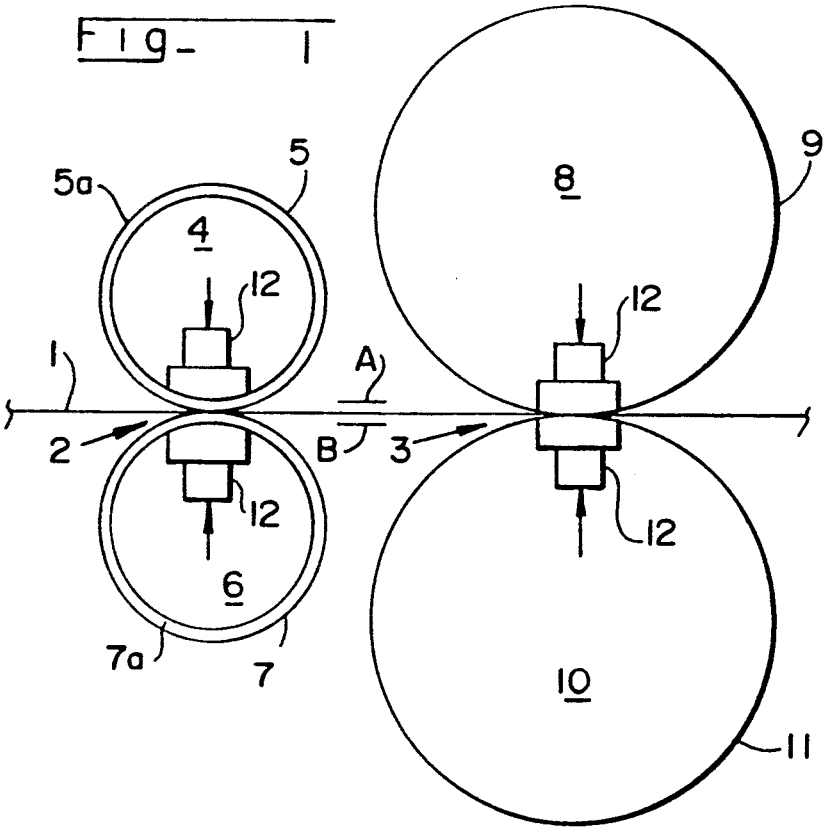
Fig- 2
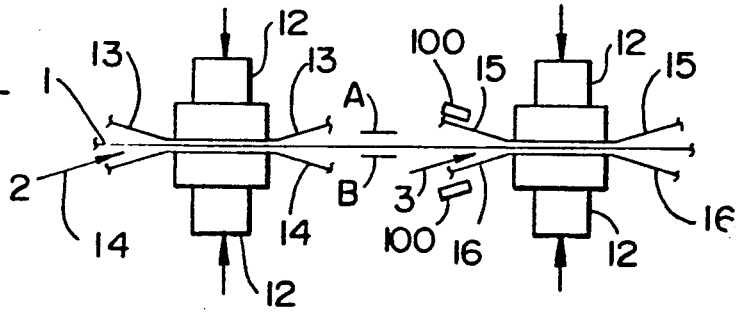
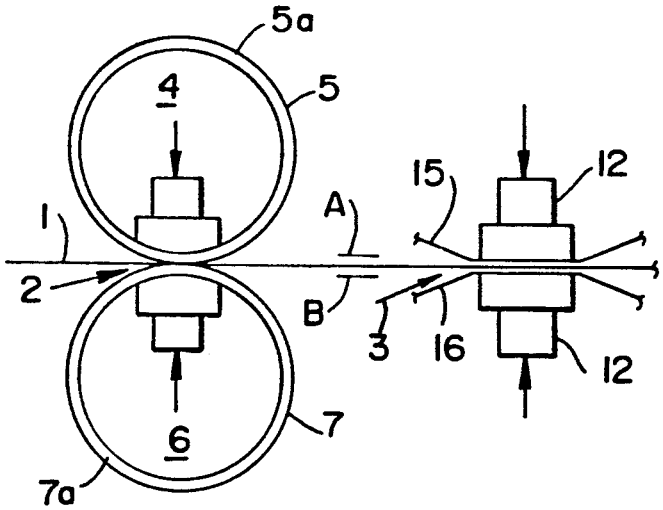
Fig- 3

METHOD FOR CALENDERING A PAPER OR CARDBOARD WEB COATED AT BOTH SIDES

BACKGROUND OF THE INVENTION

1. Field of the Invention

The present invention relates to a new and improved method of calendering a material web, in particular, a paper or cardboard web preferably, although not necessarily coated at both sides or faces thereof.

In its more specific aspects, there is disclosed a method of calendering, that is to say, smoothing and glazing a material web, in particular, a paper or cardboard web which is preferably, although not necessarily coated at both sides or faces within at least two treatment nips or gaps arranged in succession with respect to a predetermined direction of travel of the material web. This material web has imparted to both of its web sides or faces a desired smoothing effect or smoothness and a desired glaze or gloss.

2. Discussion of the Background and Material Information

The calendering or calender treatment usually constitutes the last process stage during the manufacture of paper or cardboard. For this purpose there are employed apparatuses such as, for example, so-called calender installations or supercalenders. They serve for the calender treatment of the paper or cardboard web at both sides or also even at one side thereof. There are available calender installations having so-called "hard" and "soft" treatment nips or gaps. In the case of calender installations containing the hard nips, the surfaces which bound or delimit both sides of the treatment nip are practically non-yieldably hard, and for those calender installations containing soft nips there is usually employed a yieldable elastic surface at least at one side of the treatment nip. The hard surfaces are frequently heated.

The commercially available calender of the assignee of the present invention, sold under the trademark "NipcoMat", constitutes a calender having soft treatment nips. This calender can be provided with one or a number of treatment nips. The surfaces bounding the treatment nips are typically formed by rolls or cylinders having hard metal roll or cylinder surfaces or elastically yieldable coated roll or cylinder surfaces.

There have also been proposed calender installations or calenders where the treatment nip is formed between two revolving bands or belts. Significant in this regard is the commonly assigned German Patent Publication No. 3,920,204, published May 10, 1990. The dual-sided calendering of paper or cardboard coated at both sides or faces usually is accomplished in at least two successively arranged soft treatment nips, and each web side or face is processed at both hard and also elastically soft rolls. When operating with only two treatment nips, then, in the first treatment nip the one side or face of the material web comes into contact with a hard roll and the opposite side or face with a soft roll. In the second treatment nip, the web side or face which was previously processed by the hard roll now comes into contact with a soft roll, and conversely, the other web side or face, which was previously in contact with a soft roll, now comes into contact with a hard roll. A drawback which has been found to exist with this calendering method, particularly when processing high-glaze types of paper or cardboard, resides in the fact that the high degree of glaze or gloss which has been attained at the one web side or face due to web contact with the hot, hard surfaces of the heated rolls, is again diminished in the subsequent treatment nip when the web comes into contact with rolls having yieldable elastic surfaces.

SUMMARY OF THE INVENTION

Therefore, with the foregoing in mind, it is a primary object of the present invention to provide an improved method of calendering a material web, especially, although not exclusively, a paper or cardboard web which is coated at both sides or faces, which is not afflicted with the aforementioned drawbacks or limitations of the prior art.

Another and more specific object of the present invention aims at the provision of a method of calendering a material web, especially a paper or cardboard web which is coated at both sides or faces, wherein at the finished product there is obtained an enhanced smoothing and as great as possible degree of glaze or gloss, and specifically, to the same extent at both sides or faces of the treated material web.

Still a further noteworthy object of the present invention, and in keeping with the immediately preceding object, is the provision of a method of calendering a material web, especially a paper or cardboard web which is preferably, although need not always be, coated at both sides or faces, to achieve the aforenoted results at the finished product, while allowing the use of apparatus structure which enables optimizing the treatment method during operation of the apparatus.

Now in order to implement these and still further objects of the present invention, which will become more readily apparent as the description proceeds, the web calendering method of the present development for the purpose of achieving the desired treatment effect at both sides of the material web as concerns the desired web smoothness and the desired web glaze or gloss is manifested, among other things, by the features of initially movably guiding the material web through a first nip formed between yieldable mutually adjustable elastic surfaces which confront the throughpassing material web, and thereafter movably guiding the material web through a successively arranged second nip formed between hard mutually adjustable surfaces which confront the throughpassing material web. In the first nip there is produced at both sides of the material web, through application of pressure, an increase in web smoothness and gloss, and in the second nip there is produced at both sides of the material web, through application of a lesser pressure than applied in the first nip and high thermal energy, a desired final value of web smoothness and gloss without any appreciable loss in the web smoothness and gloss achieved through treatment of the material web in the first nip.

Through the use of two nips there is achieved in the aforedescribed manner, in the first "soft" nip a surface quality of the treated material web at both sides or faces thereof which already possesses appreciable values as concerns web smoothness and gloss, through the utilization of surfaces covered with a material having a comparatively high modulus of elasticity and through the use of a high treatment pressure. The dynamic modulus of elasticity of the elastic material in radial direction should advantageously possess a value amounting to between 2,000 and 10,000 $N/m^2$. In the second "hard" nip there are appreciably increased the smoothness value and gloss value of the treated material web which have been attained in the first nip and such smoothness and gloss values are beneficially retained at the finished product. In desired manner, the material web possesses at both sides thereof an equally high or great smoothness and an equally high or great glaze or gloss.

Suitable materials for forming the cover layer for the surfaces of the first "soft" nip comprise, for instance, rubber, polyurethane, polyester and epoxy resins, which, if desired, can contain a suitable filler. Steel comprises a preferred material for forming the surfaces of the second "hard" nip. The pressure typically applied in the first "soft" nip is in the range of 5 $N/mm^2$ to 50 $N/mm^2$ and in the second "hard" nip in the range of 5 $N/mm^2$ to 30 $N/mm^2$. The temperature which prevails in the second "hard" nip lies in the order of about 100° C. to 350°0 C.

A further aspect of the invention contemplates providing in the first nip, as the yieldable mutually adjustable elastic surfaces, two rolls having elastic surfaces which are yieldable in a direction substantially perpendicular to the material web, and providing in the second nip, as t he hard mutually adjustable surfaces, two rolls having hard essentially non-yieldable surfaces.

The diameters of the rolls in the first "soft" nip are less than about 1,000 mm. and preferably below 700 mm. and the diameters of the rolls in the second "hard" nip are greater than 800 mm. and preferably greater than 1,000 mm.

Still further the material web in the first nip is advantageously processed between the elastic surfaces of the two rolls in the first nip which possess a high modulus of elasticity. Moreover, there can be provided as the two rolls in the second nip respective rolls of sufficiently large roll diameter for achieving a large heat transfer to the material web in the second nip.

The calendering method of the present invention contemplates producing a predetermined linear or line pressure in the first and second nips by providing at least predetermined ones of the rolls of the first and second nips with pressure-regulatable support or pressure elements. Also, the material web in the second nip can be heated by the pressure-regulatable support or pressure elements provided for at least predetermined ones of the rolls of the second nip.

Still further, there can be provided in the first nip, as the yieldable mutually adjustable elastic surfaces, two revolving belts having elastic surfaces which are yieldable in a direction substantially perpendicular to the material web. Furthermore, there can be adjusted the action of the two revolving belts upon the material web by support or pressure elements. The material web is desirably processed in the first nip between the two revolving belts whose elastic surfaces possess a high modulus of elasticity.

Additionally, there can be provided in the second nip, as the hard mutually adjustable surfaces, two revolving steel belts. Moreover, there can be employed support or pressure elements for adjusting the action of the two revolving steel belts upon the material web. The material web can be heated in the second nip by the support or pressure elements. But it is also possible to inductively heat the revolving steel belts in the second nip in order to apply thermal energy to the material web in the second nip.

A further aspect of the inventive web treatment method conceives asymmetrically heating the material web in order to achieve a reduction in the web smoothness and gloss at one of both sides of the material web in relation to the other side of the material web.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 schematically illustrates a first embodiment of calender or calender installation for performance of the inventive method;

FIG. 2 schematically illustrates a second embodiment of calender or calender installation for performance of the inventive method; and FIG. 3 schematically illustrates a third embodiment of calender or calender installation for performance of the inventive method.

DETAILED DESCRIPTION OF THE PREFERRED EMBODIMENTS

Describing now the drawings, it is to be understood that only enough of the construction of the various embodiments of calenders for the treatment or calendering of a material web have been depicted therein, in order to simplify the illustration, as needed for those skilled in the art to readily understand the underlying principles and concepts of the present invention.

Turning attention first to the calender depicted in FIG. 1, it will be understood that a material web, and specifically, a paper or cardboard web 1 which is to be treated at both web sides or faces A and B and here, for instance, coated at both such web sides A and B, is movingly guided through a first nip 2 at a suitable travel velocity. This first nip 2 is formed between two rotatable rolls or cylinders 4 and 6 possessing yieldable elastic cylindrical roll surfaces 5 and 7, respectively. These yieldable elastic cylindrical roll surfaces 5 and 7 are constituted by the surfaces of a respective elastic yieldable material layer or covering 5*a* and 7*a* which possess a high modulus of elasticity in order to be able to work in the first nip 2 with a correspondingly high surface compression, and materials suitable for this purpose have been heretofore given. For the same reason, it is advantageous if the diameters of the rolls or cylinders 4 and 6 are chosen to be as small as possible, and typical diameter values have been heretofore discussed. The yieldable cylindrical roll surfaces 5 and 7 are advantageously adjustable, by means of any suitable conventional roll adjustment or positioning means, in a direction substantially perpendicular to the throughpassing material web 1, in order to produce the high pressure in the first nip 2 in the order of about 5 $N/mm^2$ to 50 $N/mm_2$ which acts upon the throughpassing material web 1.

At least one of the rolls or cylinders 4 and 6 can be provided with conventional pressure-regulatable support or pressure elements 12, for instance, those pressure elements sold under the trademark "NIPCO" in order generate a desired linear or line force profile in the cross-machine direction. Suitable types of pressure-regulatable support or pressure elements have been disclosed in, for example, U.S. Pat. No. 3,802,044 and the cognate German Patent Publication No. 2,230,139, published Jan. 25, 1973 and equally in U.S. Pat. No. 3,885,283 and the cognate German Patent No. 2,254,392, published May 9, 1974, to which reference may be readily had and the disclosures of which are incorporated herein in its entirety by reference.

One of the main advantages of the first "soft" nip 2 resides in the essentially uniform compaction or compression of the treated material web 1 between the yieldable elastic covering layers or covers 5*a* and 7*a* of the rolls 4 and 6, respectively. As a result thereof, there do not arise any excessive compression of the material web 1 at locations thereof having higher surface weight.

The material web 1 treated in the first nip 2 is movably guided, with the same travel velocity with which it previously moved through this first nip 2, through a further or second nip 3 arranged in succession after or downstream of the first nip 2 with respect to the predetermined direction of travel of the material web 1. This second nip 3 is formed between two rotatable rolls or cylinders 8 and 10 which are formed, for instance, from a hard steel casting and possessing the respective hard cylindrical surfaces 9 and 11. In this second nip 3 heat and pressure are applied to both sides A and B of the material web 1. As heretofore explained, the temperature prevailing in the second nip is in the order of 100° C. to 350° C. and the pressure lies between about 5 $N/mm^2$ to 30 $N/mm^2$. In particular, for augmenting the web glaze or gloss, as large as possible quantity of heat or thermal energy should be applied from the rolls or cylinders 8 and 10 to the material web 1. To that end, the heat transfer surfaces at the rolls or cylinders 8 and 10 are maintained as large as possible by selecting as large as possible diameter of each of the rolls 8 and 10, as previously discussed. At least one of these rolls 8 and 10 can be likewise equipped with pressure elements 12, for instance, those pressure elements sold under the trademark "NIPCO". The other roll or roller could be, for instance, constituted by a conventional regulatable thermo-roll. These rolls or cylinders 8 and 10 are thus regulatably heatable. For this purpose, there also could be conventionally employed the "NIPCO"-type support or pressure elements 12 through which there then can be regulatably supplied a suitable heat-carrying pressurized fluid medium, such as oil, as is well known in this technology.

The regulatability of the heating of the rolls or cylinders 8 and 10 affords the possibility of accommodation of the web treatment method for achieving desired web treatment results. For instance, by asymmetrically heating opposites sides or faces A and B of the material web 1 there can be attained a reduction in the smoothing and glaze at the two sides A and B of the material web i in relation to one another.

The second stage of web calendering in the second nip 3 results in an increase in the quality of the material web 1 at the two sides A and B which has been previously achieved in the upstream situated first nip 2. Following such further web treatment there can be ascertained increased values of the smoothness and glaze of the thus processed material web 1 in contrast to the smoothness and glaze values of the material web 1 attained in the first nip 2, and moreover, these increased web smoothness and glaze values are retained in the final or end product. The regulatability of the heating of the rolls or cylinders 8 and 10 also affords correction possibilities over the web width by adjusting the heating action in zones in the cross-machine direction.

Within the second nip 3 the pressing pressure or compression applied to the material web 1 should be maintained as small as possible, in order to preclude local compression or squeezing of the material web 1. However, there should be applied a relatively high temperature. It is for this reason that, as already mentioned, there also should be provided a large heat transfer surface in the second nip 3. Large roll surfaces enhance, apart from the web smoothness, also the web glaze or gloss.

It is here to be remarked that the invention further contemplates a calender construction where there are successively arranged more than one nip of each of the nip types constituted by the aforedescribed treatment nips 2 and 3. In any event, there should be first arranged the "soft" nip, such as the heretofore described first nip 2, followed by the "hard" nip, such as the heretofore described second nip 3

It is also contemplated that, when necessary or desired, to advantageously arrange along the treatment path or predetermined direction of travel of the material web 1 suitable known means, for instance, for moistening or heating the material web 1 upstream or the treatment nips or for ventilating, cooling or suctionally removing the vapors after a treatment nip, which further enhance the attainment of still greater web smoothness and glaze values.

Based upon the showing of FIG. 2 there will be considered a second embodiment of calender or calender installation suitable for the practice of the inventive method. Here, the surfaces delimiting or bounding the relevant first nip 2 and second nip 3 are constituted by revolving endless belts or bands 13, 14 and 15, 16, respectively, which are guided through the associated treatment nip 2 and 3. The material web 1 is movingly guided through the first nip 2 between surfaces of the belts or bands 13 and 14 which revolve during operation of the calender and which are guided through the first nip 2. These revolving belts or bands !3 and 14 are elastically yieldable at least at the sides thereof confronting the throughpassing material web 1. Due to the elastic yieldability of the revolving belts 13 and 14 there are extensively avoided the formation of localized overcompression of the material web 1. Both of the revolving endless belts 13 and 14 can be similarly constructed and appropriately driven to revolve at the same speed. In this first nip 2 there is predominantly applied pressure to the throughpassing material web 1. This pressure is advantageously produced by means of pressure-regulatable support or pressure elements 12, as previously considered.

After departure from the first nip 2 the material web 1 is subsequently movingly guided through the next following second nip 3 which is successively arranged with respect to the predetermined direction of travel of the material web 1. In this second nip 3 the material web 1 is movingly guided between the endless steel belts or bands 15 and 16, which revolve during operation of the calender and move through the second nip 3, and possess the confronting hard belt surfaces which contact the throughpassing material web 1. The travel velocity of the material web within the second nip 3, dictated by the circumferential velocity of the revolving steel belts or bands 15 and 16, is the same as the travel velocity of the material web 1 passing through the upstream arranged first nip 2. Heat and pressure are applied to the material web 1 within the second nip 3. The pressure is exerted by means of the regulatable support or pressure elements 12, the forces of which are applied to the revolving belts or bands 15 and 16. Also, here, there are advantageously employed pressure elements, for instance, those pressure elements sold under the trademark "NIPCO". Once again, the heating of the revolving belts or bands 15 and 16 can be achieved with these support or pressure elements 12 which, for this purpose, are supplied with a suitable heat-carrying fluid medium, oil for instance. However, the heating of the revolving belts 15 and 16, and thus, the throughpassing material web 1 in contact therewith, can be accomplished in a different manner, for instance there can be used suitable inductive heaters 100. Also the second nip 3 can be extended in length in the direction of travel of the material web 1.

Through the provision of a "long" or "extended" second nip 3 there results an increased residence time of the material web 1 when travelling through the second nip 3. As a result, it is possible to work with a reduced pressure in the second nip 3 in comparison to the pressure employed in the first nip 2, so that there is further reduced the risk of localized over-compression of the material web 1 within this second nip 3. The selection of a lower web pressing or compression pressure is also possible because the heat transfer surfaces afford an advantageous transfer of thermal energy to the throughpassing material web 1, so that there is enhanced the web smoothness and especially the formation of web glaze or gloss. Within the second nip 3 there does not arise an loss in the glaze of the treated material web 1. Here also, by asymmetrically heating the revolving belts or bands 15 and 16 there can be achieved a different treatment of the opposite sides or faces A and B of the material web 1.

The revolving endless belts 13 and 14 forming the first nip 2 can be formed of materials like those employed for the rolls or cylinders 4 and 6 of the embodiment of FIG. 1.

Finally, in FIG. 3 there is depicted a third embodiment of calender or calender installation for the practice of the inventive web calendering method. It can be advantageous to form the first nip 2 between two yieldable elastically coated or covered rolls or cylinders 4 and 6, as previously described for the first embodiment of FIG. 1, and to form the second nip 3 between two revolving endless belts or bands 15 and 16 each possessing a hard, practically non-yieldable surface, as such has been described in conjunction with the second embodiment of calender depicted in FIG. 2.

However, it is here mentioned that still a further variant construction of calender is possible likewise constituting a combination of the calenders considered heretofore in conjunction with FIGS. 1 and 2. Specifically, the first nip 2 could be formed, in the manner as shown in FIG. 2, between elastic yieldably coated or covered belts or bands, and the second nip 3 then, as depicted in FIG. 1, would be formed between two heated hard rolls or cylinders of larger diameter. Since this modified embodiment can be easily conceived from the explanations given and the illustrations of the calenders shown in the drawings, it has not been specifically depicted herein.

For certain technological fields of application, it can be advantageous to also heat to a modest temperature with conventional heating means the elastic yieldable rolls and/or the coverings or cover layers of the revolving endless bands or belts.

By way of completeness, it is noted that for the embodiments of FIGS. 2 and 3, the operating conditions prevailing in the first "soft" nip and second "hard" nip are like those given for the embodiment of FIG. 1.

The inventive method is not solely limited to the calendering of double-sided coated paper or cardboard webs. It can be employed to advantage, with the realization of good results, also for calendering uncoated material webs and material webs which have only been coated at one side or face thereof.

While there are shown and described present preferred embodiments of the invention, it is distinctly to be understood the invention is not limited thereto, but may be otherwise variously embodied and practiced within the scope of the following claims.

We claim:

1. A method of calendering a material web to impart a desired smoothness and a desired glaze to both sides of the material web, comprising the steps of:

movably guiding the material web through a first nip formed between yieldable mutually adjustable elastic surfaces which confront the throughpassing material web;

applying to the material web in the first nip a predetermined pressure for producing on both sides of the material increase in web smoothness and glaze;

thereafter movably guiding the material web through a successively arranged second nip formed between hard mutually adjustable surfaces which confront the throughpassing material web; and applying to the material web in the second nip a pressure which is lower than the predetermined pressure applied in the first nip and high thermal energy, in order to attain on both sides of the material web a desired final value of web smoothness and glaze without any appreciable loss in the web smoothness and glaze achieved through treatment of the material web in the first nip.

2. The method as defined in claim 1, further including the steps of:

providing int he first nip, as the yieldable mutually adjustable elastic surfaces, two rolls having elastic surfaces which are yieldable in a direction substantially perpendicular to the material web; and providing in the second nip, as the hard mutually adjustable surfaces, two rolls having hard essentially non-yieldable surfaces.

3. The method as defined in claim 2, further including the step of:

providing as said two rolls in the second nip respective rolls of sufficiently large roll diameter for achieving high heat transfer to the material web in the second nip.

4. The method as defined in claim 3, further including the step of:

producing a predetermined linear pressure in the first and second nips by providing at least predetermined ones of the rolls of the first and second nips with pressure-regulatable support elements.

5. The method as defined in claim 4, further including the step of:

heating the material web in the second nip by the pressure-regulatable support elements provided for at least predetermined ones of the rolls of the second nip.

6. The method as defined in claim 2, further including the step of:

processing the material web in the first nip between the elastic surfaces of the two rolls in the first nip which possess a high modulus of elasticity.

7. The method as defined in claim 1, further including the step of:

providing in the first nip, as the yieldable mutually adjustable elastic surfaces, two revolving belts having elastic surfaces which are yieldable in a direction substantially perpendicular to the material web.

8. The method as defined in claim 7, further including the step of:

adjusting the action of the two revolving belts upon the material web by support elements.

9. The method as defined in claim 8, further including the step of:

processing the material web in the first nip between the two revolving belts whose elastic surfaces possess a high modulus of elasticity.

10. The method as defined in claim 1, further including the step of:

providing in the second nip, as the hard mutually adjustable surfaces, two revolving steel belts.

11. The method as defined in claim 10, further including the step of:

adjusting the action of the two revolving steel belts upon the material web by support elements.

12. The method as defined in claim 11, further including the step of:

heating the material web in the second nip by means of the support elements.

13. The method as defined in claim 10, further including the step of:

inductively heating the revolving steel belts in the second nip in order to apply thermal energy to the material web in the second nip.

14. The method as defined in claim 1, further including the step of:

asymmetrically heating the material web in order to achieve a reduction in the web smoothness and glaze at one of both sides of the material web in relation to the other side of the material web.

15. A method as defined in claim 1, wherein the material web comprises at least one member selected from the group consisting of a coated paper and a cardboard web.

16. A method of calendering a material web, to impart a desired smoothness and a desired glaze to both sides of the material web, comprising the steps of:

movable guiding the material web through a first nip formed between yieldable elastic surfaces which confront the throughpassing material web;

applying to the material web in the first nip a predetermined pressure for producing on both sides of the material web an increase in web smoothness and glaze;

thereafter movably guiding the material web through a successively arranged second nip formed between hard surfaces which confront the throughpassing material web; and applying to the material web in the second nip a pressure which is lower than the predetermined pressure applied in the first nip and high thermal energy, in order to attain on both sides of the material web a desired final value of web smoothness and glaze achieved through treatment of the material web in the first nip.

* * * * *